US006961961B1

(12) United States Patent
Ezra

(10) Patent No.: US 6,961,961 B1
(45) Date of Patent: Nov. 8, 2005

(54) BOTTLE HOLDER

(76) Inventor: Sima Ezra, 5312 Spalding Mill Pl., Norcross, GA (US) 30092

( * ) Notice: Subject to any disclaimer, the term of this patent is extended or adjusted under 35 U.S.C. 154(b) by 0 days.

(21) Appl. No.: 10/624,732

(22) Filed: Jul. 22, 2003

(51) Int. Cl.[7] ..... A41B 13/00
(52) U.S. Cl. ..... 2/49.1
(58) Field of Search ..... 2/49.1, 49.2, 48, 2/50–52, 102, 94, 75, 80, 111; 248/102, 104, 248/105

(56) References Cited

U.S. PATENT DOCUMENTS

| | | | | |
|---|---|---|---|---|
| D162,793 | S | 4/1951 | Daust | |
| 2,631,288 | A | 3/1953 | Daust | |
| D211,435 | S | 6/1968 | Kausen | |
| 4,473,907 | A | 10/1984 | Maillard | |
| 4,710,979 | A * | 12/1987 | Bull et al. | 2/48 |
| 4,985,327 | A | 1/1991 | Sakashita et al. | |
| 5,184,796 | A | 2/1993 | Maher | |
| 5,312,282 | A | 5/1994 | Cooper | |
| D379,660 | S | 6/1997 | Aube | |
| 5,765,225 | A | 6/1998 | Goeckeritz et al. | |
| 5,820,084 | A * | 10/1998 | Trumbauer et al. | 248/102 |
| D403,489 | S | 1/1999 | Cameron | |
| 6,000,664 | A | 12/1999 | Hood | |
| 6,055,667 | A | 5/2000 | Jimenez | |
| 6,098,934 | A | 8/2000 | Skelton | |
| D432,759 | S | 10/2000 | Krolczyk et al. | |
| D444,934 | S | 7/2001 | Ross | |
| 6,442,759 | B1 * | 9/2002 | Straham et al. | 2/49.1 |

* cited by examiner

*Primary Examiner*—Tejash Patel

(57) ABSTRACT

A bib bottle holder is described. Typically, a main bib body is flat and is shaped similarly to a conventional bib. A bib pillow type is attached to the main bib body with suitable fasteners such as hook and loop fasteners. A bottle loop with fasteners such as hook and loop fasteners or an elastic strip is connected to the bib pillow and is used to position the bottle similar to as described above. Animal characters, rattles and other toys can be added to either embodiment for the baby's entertainment and stimulation while feeding.

12 Claims, 3 Drawing Sheets

BOTTLE HOLDER

BACKGROUND

I. Field of the Invention

The present invention relates generally to the field infant products and, more particularly, to a bottle holder system and apparatus.

II. Description of the Related Art

Conventional baby bibs are typically used to affix around a baby's neck to keep food, liquids, spit-up and other messes off the baby and the baby's cloths. Certain attempts have been made to attach a bottle to a bib to hold the bottle in proximity of a baby's mouth. However, these bibs include attachments that hold the bottle generally flat or parallel against the bib requiring a care-giver to hold the bottle at a proper angle so that the baby can feed from the bottle. These bibs typically do not allow a hands free feeding option to the care giver using the bib.

SUMMARY

In general, the invention features a bib bottle holder. One embodiment can include a main bib body that can be secured around a baby's neck similar to conventional bibs. The main bib body can be stuffed with a suitable filler such as polyester stuffing to give the main bib body a general pillow shape. A fabric strip with fasteners such as hook and loop fasteners or an elastic strip is connected to the main bib body. This strip is used to wrap around a bottle to hold the bottle in place for a baby, who is generally in a prone or semi-reclined position. The main bib body is stuffed in such a manner so that the bottle is placed at an angle sufficient for baby feeding. In another embodiment, the main bib body is flat and is shaped similarly to a conventional bib. The embodiment further includes a bib pillow that is attached to the main bib body with suitable fasteners such as hook and loop fasteners. A bottle loop with fasteners such as hook and loop fasteners or an elastic strip is connected to the bib pillow and is used to position the bottle similar to as described above. Animal characters, rattles and other toys can be added to either embodiment for the baby's entertainment and stimulation while feeding.

In general, in one aspect, the invention features a bib, including a main bib body having an upper surface and a lower surface, a bib pillow having an upper and lower surface, the lower surface of the bib pillow being connected to the upper surface of the main bib body and a bottle loop connected to the upper surface of the bib pillow.

In one implementation, the main bib body further comprises neck straps that define a neck loop.

In another implementation, the main bib body further comprises a border.

In another implementation, the main bib body further comprises connector loops connected to leads.

In another implementation, the bib pillow further includes a front end and a rear end.

In another implementation, the bib further includes baffles located on the front end of the bib pillow.

In another implementation, the bib further includes a depression formed in the baffles.

In another implementation, the bib further includes micro-depressions located between the baffles.

In another implementation, the bib further includes ends located on the bottle loop and pivotally connected to the bib pillow.

In still another implementation, the bib pillow is connected to the main bib body with fasteners and the bottle loop is connected to the bib pillow with fasteners.

In another aspect, the invention features a bottle holder kit, including a main bib body, a bib pillow adapted to connect to the main bib body, a bottle loop adapted to be connected to the bib pillow, a bottle having a nipple, the bottle being adapted to be held against the bib pillow and within the bottle loop and baby toys adapted to be connected to the main bib body.

In one implementation, the kit further includes fasteners adapted to interconnect the main bib body with the bib pillow and the bib pillow with the bottle loop.

In another implementation, the kit further includes connector loops connected to a border of the main bib body and leads adapted to be connected to the connector loops and the baby toys.

In another implementation, the kit further includes baffles located on a front end of the bib pillow, the baffles being adapted to control the freedom of motion of the nipple when the bottle is placed in the bottle loop.

In another aspect, the invention features a bib system, including a main bib body having an upper surface and a lower surface, a bib pillow having an upper and lower surface, the lower surface of the bib pillow being connected to the upper surface of the main bib body, a bottle loop connected to the upper surface of the bib pillow, a bottle having a nipple, the bottle being held against the upper surface of the bib pillow and within the bottle loop, and baby toys connected to leads that are connected to the main bib body.

One advantage of the invention is that the bib pillow maintains a baby bottle at an optimum position for feeding.

Another advantage of the invention is that it permits a baby to feed himself when he is too young to hold a bottle himself and bring the bottle to his mouth.

Another advantage of the invention is that it permits parents to feed a baby when they are unable to hold the bottle to the baby's mouth.

Another advantage of the invention is that it permits parents to feed multiple baby's at one time.

Another advantage of the invention is that it holds a bottle at an optimum angle minimizing the amount of air that passes through to the baby's mouth.

Other objects, advantages and capabilities of the invention will become apparent from the following description taken in conjunction with the accompanying drawings showing the preferred embodiment of the invention.

DETAILED DESCRIPTION

Figure 1:
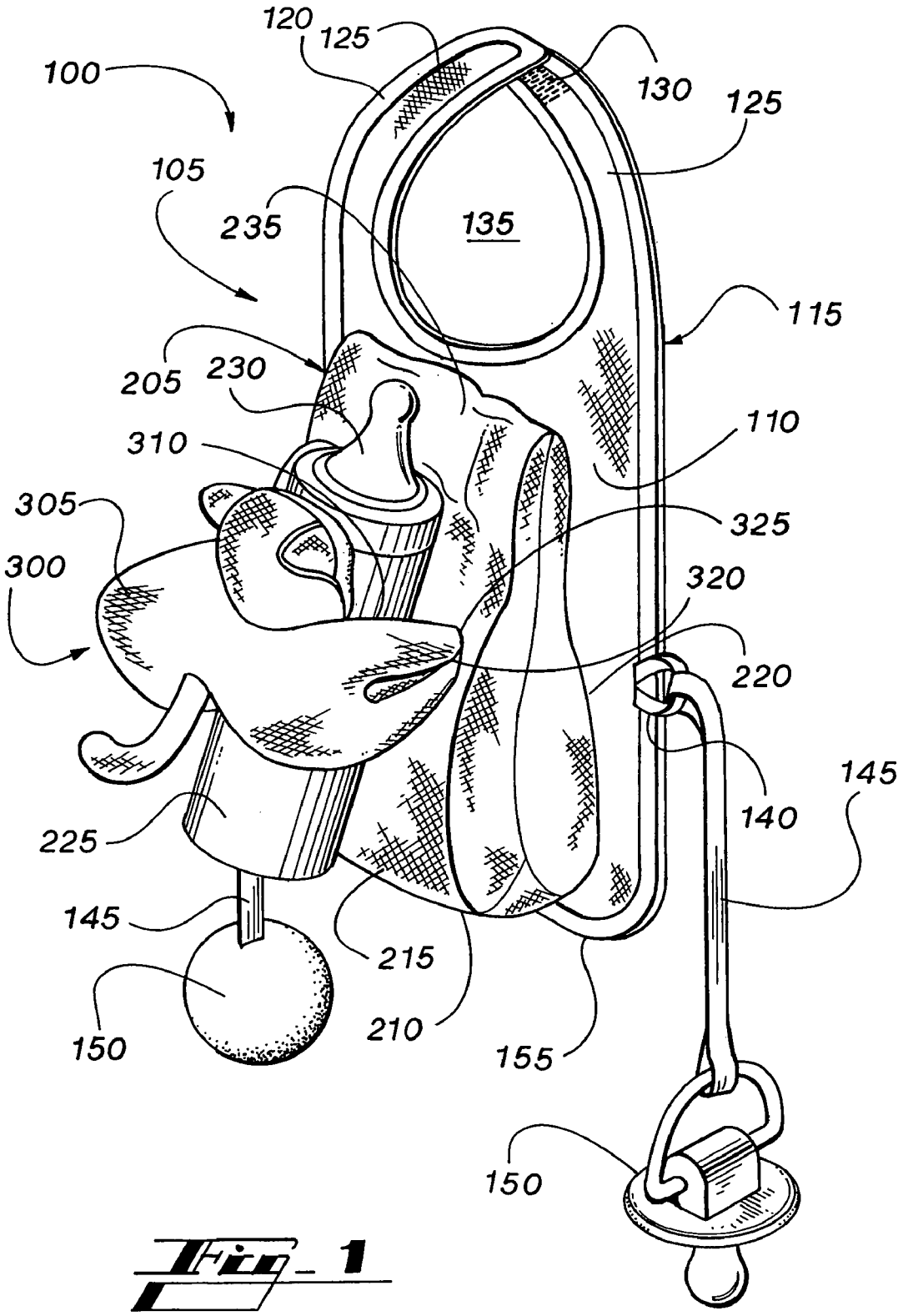
FIG. 1 illustrates a side perspective view of an embodiment of a bottle holder.

Referring to the drawings wherein like reference numerals designate corresponding parts throughout the several figures, reference is made first to FIG. 1 that illustrates a side perspective view of an embodiment of a bottle holder 100. The bottle holder 100 generally includes a main bib body 105 having an upper surface 110 and a lower surface 115.

The main bib body 105 generally includes a border 120 connected to the entire perimeter of the main bib body 105. The main bib body 105 generally further includes neck straps 125, each including a suitable fastener 130. In a typical embodiment, the fasteners 130 can be, but are not limited to, hook and loop fasteners, snaps and the like. When the fasteners 103 of the neck straps 125 are interconnected, a neck loop 135 is formed through which a baby's neck is fitted. The main bib body 105 generally further includes a lower end 155. The main bib body can be a variety of materials suitable for a bib such as plastic and cloth. It is understood that there are a variety of suitable materials and specific cloth types of which the main bib body 105 can be comprised. In another embodiment, the main bib body 105 can be filled with a filling material between the upper and lower surfaces 110, 115.

The main bib body 105 can further include one or more connector loops 140 that can receive leads 145 that are connected to baby toys and accessories 150. Such toys and accessories 150 can include but are not limited to pacifiers, loops, balls, stuffed animals and the like.

The bottle holder 100 further includes a bib pillow 200 that is generally connected to the upper surface 110 of the main bib body 105. The bib pillow 200 generally includes a front end 205 and a rear end 210, an upper surface 215 and a lower surface 220. The pillow 200 can be filled with any suitable filler. In general, the lower surface 220 of the bib pillow 200 is connected to the upper surface 110 of the main bib body 105. The front end 205 of the bib pillow 200 is generally positioned adjacent the neck loop 135. The rear end 210 of the bib pillow 200 is generally adjacent the lower end 155 of the main bib body 105. In one embodiment the rear end 210 of the bib pillow 200 is positioned higher than the front end 205 so that a bottle 225 resting on the upper surface 215 is generally angled toward the neck loop 135 so that when the bottle holder 100 is placed on a baby, the nipple 230 of the bottle 225 is positioned adjacent the baby's mouth for easy feeding. In one embodiment, a depression 235 can be defined in the front end 205 of the pillow 200 to allow some additional freedom of motion for the nipple 230 as the baby is feeding.

The bottle holder 100 generally further includes a bottle loop 300. The bottle loop defines an opening 310 through which the bottle 225 can fit and be secured. In general, the bottle loop 300 includes a main body 305 that can be shaped into a variety of forms, including, but not limited to animals, clowns, smiley faces and the like. The body 305 can also be filled with a suitable filler similar to the main bib body 105 and the bib pillow 200 as described above. The bottle loop 300 is generally connected to the upper surface 215 of the bib pillow 200. In one embodiment, two ends 320 of the body 305 are pivotally connected to the upper surface 215 at points 325. The pivotal connection allows the freedom of motion for the nipple 230 in the depression 235 as described above. In general, as the nipple 230 is moved by the baby, the entire bottle 225 can also be moved. By having a pivotal connection at points 325, the entire bottle loop 300 can also move as the bottle 225 is moved. Furthermore, if the bottle is moved with enough force, torque can be applied to the bib pillow 200, which can also be moved. If still enough force is applied to the bottle 225, a portion of the main bib body 105 can also be moved since all of the constituent components are connected. In another embodiment, the bottle loop 300 can be a simple fabric strip.

Figure 2:
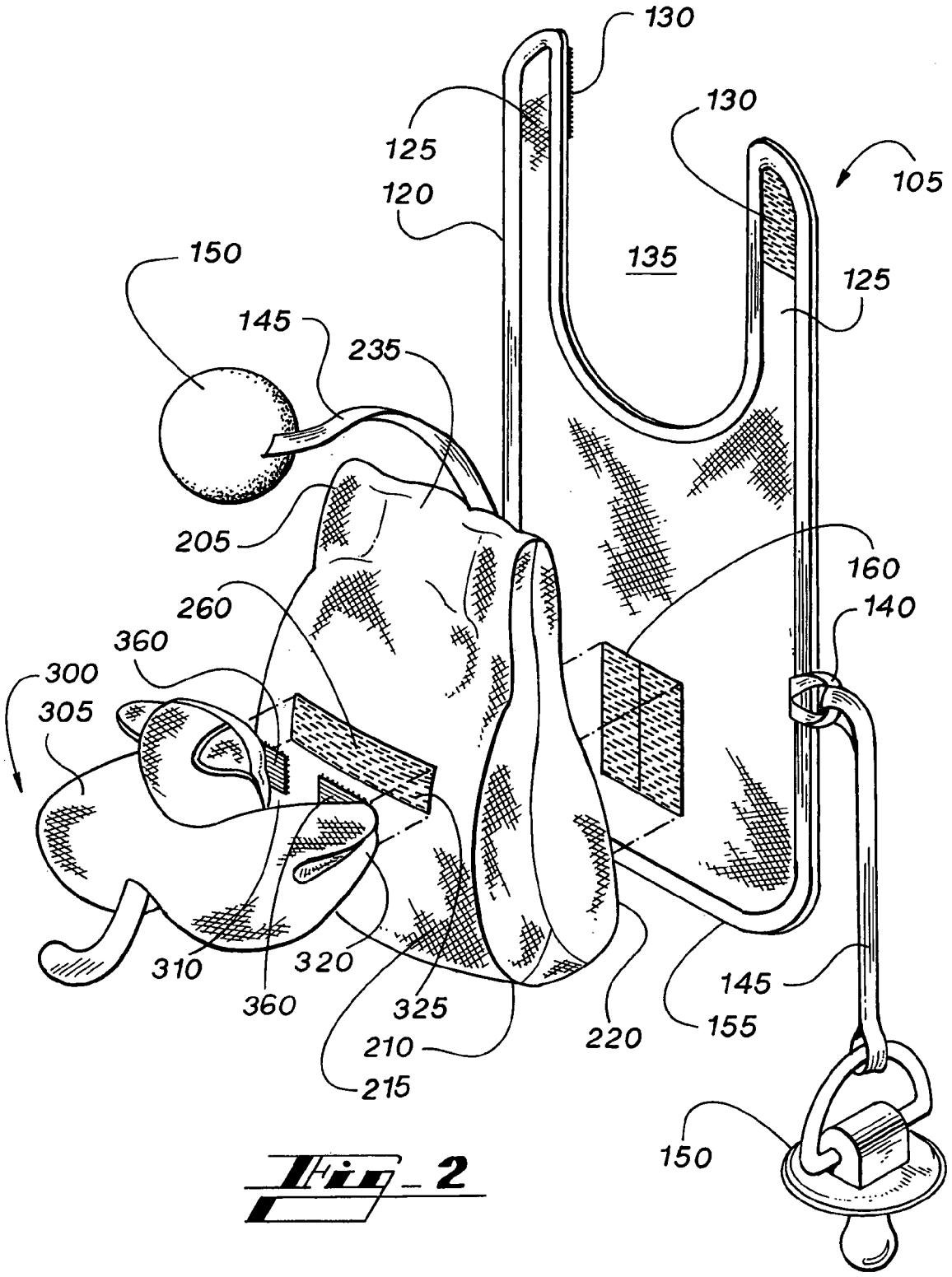
FIG. 2 illustrates a side perspective view of the constituent components of an embodiment of a bottle holder.

FIG. 2 illustrates a side perspective view of the constituent components of an embodiment of a bottle holder 100. The bottle 225 has been removed for illustrative purposes. As described above, the constituent components include the main bib body 105, the bib pillow 200 and the bottle loop 300. The main bib body 105 can further include a suitable 160 fastener, such as but not limited to hook and loop fasteners, snaps and the like, connected to the upper surface 110 of the main bib body 105. A mating fastener can be connected to the lower surface 220 of the bib pillow 200. In general, therefore, in one embodiment, the main bib body 105 and the bib pillow 200 can be connected and disconnected as needed, for example, if the main bib body 105 is to be used as a simple conventional bib. Furthermore, the interconnection can allow the bib pillow 200 to be placed at a variety of locations along the upper surface 110 of the main bib body 105. In still another embodiment, the surface area and location of the fasteners 160 can be limited in order for the bib pillow 200 to be placed at specific locations within the border 120 of the main bib body 105, typically with the front end 205 of the bib pillow 200 adjacent the neck loop 135. In other embodiment, the surface area and location of the fasteners 160 can be limited so that the bib pillow 200 can be placed virtually anywhere on the main bib body 105.

Similarly, the bib pillow 200 can include a fastener 260 on the upper surface 215. A mating fastener 360 can be connected to the ends 320 of the bottle loop 300. In general, therefore, in one embodiment, the bib pillow 200 and the bottle loop 300 can be connected and disconnected as needed. The pivot points 325 are therefore typically defined by the interconnection of the fasteners 260, 360 and can be formed at a variety of location depending on the surface area and locations of the fasteners 260, 360. Furthermore, the interconnection can allow the bottle loop 300 to be placed at a variety of locations along the upper surface 215 of the bib pillow 200. In still another embodiment, the surface area and location of the fasteners 160 can be limited in order for the bottle loop 300 to be placed at specific locations on the upper surface 215 of the bib pillow 200. In other embodiment, the surface area and location of the fasteners 260 can be limited so that the bottle loop 300 can be placed virtually anywhere on the bib pillow 200, therefore accommodating the varying physiology of different babies.

Figure 3:
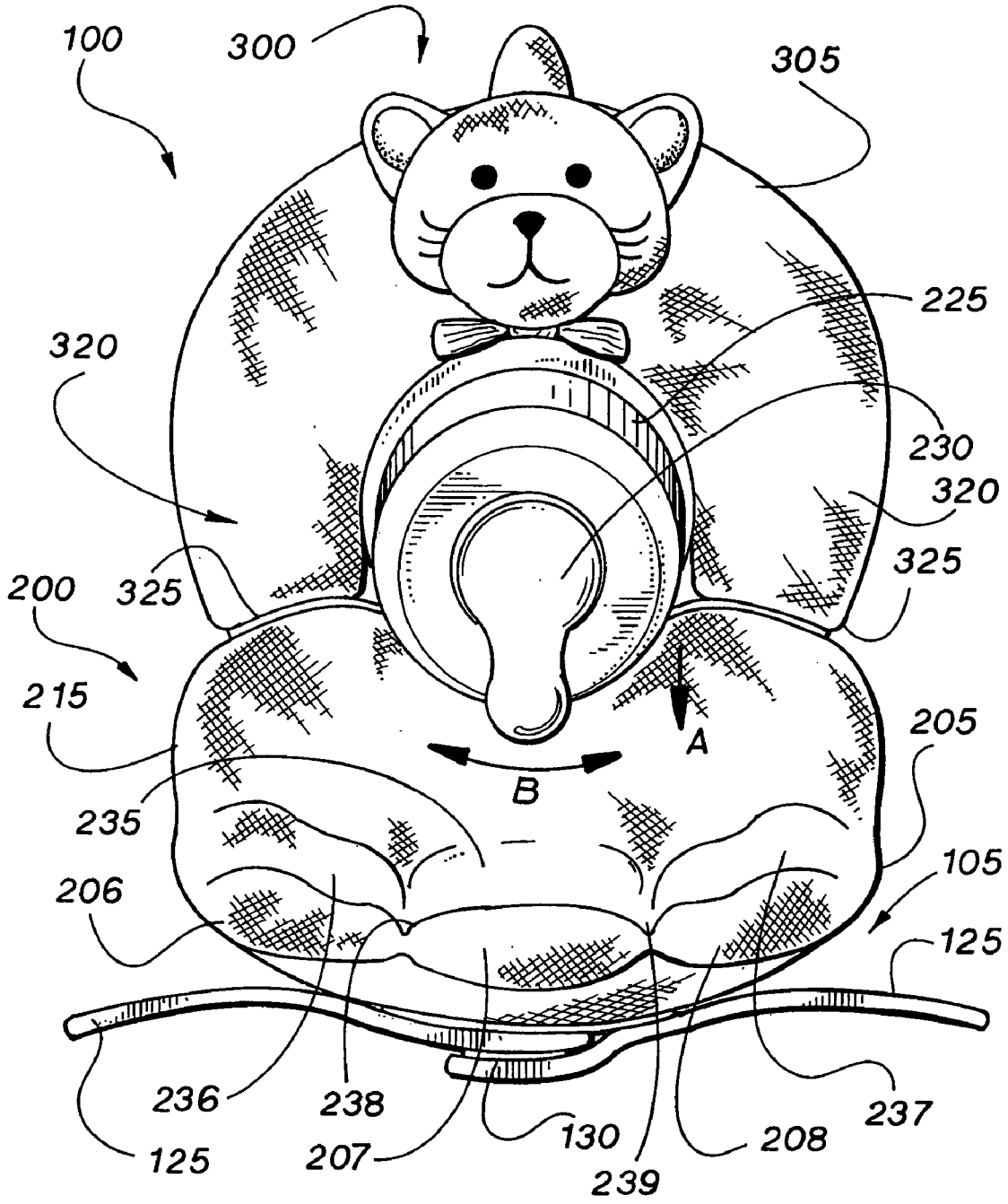
FIG. 3 illustrates a front view of an embodiment of a bottle holder.

FIG. 3 illustrates a front view of an embodiment of a bottle holder 100. A portion of the main bib body 105 and neck straps 125 are shown. A portion of the bib pillow 200 and bottle loop 300 are also shown. The figure further illustrates some of the freedom of motion through which the nipple 230 can move as defined by upward arrow A and sideward arrow B. The figure further illustrates that the front end 205 of the bib pillow 200 can be further defined into a series of baffles 206, 207, 208. The baffles 206, 207, 208 generally define the depression 235 which is flanked by angled walls 236 and 237 formed on the baffles 206, 208 respectively. Micro-depressions 238 and 239 are also generally formed between the baffles 206, 207 and baffles 207, 208, respectively. In general, the baffles 206, 207, 208, the angled walls 236, 237, the depression 235 and micro-depressions, 238, 239 all help to define and control the freedom of motion of the nipple 230 to help keep the nipple 230 positioned adjacent the baby's mouth when in use.

When the main bib body 105 is fitted onto a baby, the baby's neck is fitted through the neck loop 135 with the neck straps 125 positioned around the baby's neck. In general, the lower surface 115 of the main bib body 105 is in contact with the baby's chest and stomach areas. The lower end 155 is typically adjacent the baby's stomach area. The bib pillow 200 is positioned on the main bib body 105 in a suitable location that can optionally be variable with the use of the fasteners 160. The bottle loop 300 is typically placed onto the bib pillow 200 in a suitable location that can optionally be variable with the use of fasteners 260, 360. The bottle 225 can then be placed into the opening 310 of the bottle loop 300. In general, the bottle 225 rests against the upper surface 215 of the bib pillow 200 and is held within the opening 310 of the bottle loop 300. Adjustments can be made accordingly as needed. As the baby feeds, moves around and even spits the nipple 230 out of his mouth and retakes the nipple 230 into his mouth, the baffles 206, 207, 208, the angled walls 236, 237, the depression 235 and micro-depressions, 238, 239 all help to define and control the freedom of motion of the nipple 230 to help keep the nipple 230 positioned adjacent the baby's mouth when in use and when not in use.

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A bib, comprising:

a main bib body having an upper surface and a lower surface;

a bib pillow having an upper and lower surface, and a front end and a rear end, the lower surface of the bib pillow being connected to the upper surface of the main bib body, the upper surface being defined by a smooth curvature from the front to the rear end;

a bottle loop being closed and continuous and connected to the upper surface of the bib pillow; and baffles located on the front end of the bib pillow, the baffles including a curved wall on either side of each baffle.

2. The bib as claimed in claim 1 wherein the main bib body further comprises neck straps that define a neck loop.

3. The bib as claimed in claim 2 wherein the main bib body further comprises a border.

4. The bib as claimed in claim 1 wherein the main bib body further comprises connector loops connected to leads.

5. The bib as claimed in claim 1 further comprising a depression formed in and along the baffles, the depression being oriented generally parallel with the bottle loop and generally perpendicular to a bottle placed within the bottle loop.

6. The bib as claimed in claim 1 further comprising micro-depressions located between the baffles, being generally defined by two adjacent curved walls of adjacent baffles.

7. The bib as claimed in claim 1 further comprising ends located on the bottle loop and pivotally connected to the bib pillow.

8. The bib as claimed in claim 1 wherein the bib pillow is connected to the main bib body with fasteners and the bottle loop is connected to the bib pillow with fasteners.

9. A bottle holder kit, comprising:

a main bib body having an upper surface and a lower surface;

a bib pillow adapted to connect to the main bib body and having an upper and lower surface, and a front end and a rear end, the lower surface of the bib pillow being connected to the upper surface of the main bib body, the upper surface being defined by a smooth curvature from the front to the rear end;

a bottle loop being closed and continuous and connected to the upper surface of the bib pillow and adapted to be connected to the bib pillow;

a bottle having a nipple, the bottle being adapted to be held against the bib pillow and within the bottle loop;

baby toys adapted to be connected to the main bib body;

baffles located on a front end of the bib pillow, the baffles being adapted to control the freedom of motion of the nipple when the bottle is placed in the bottle loop, the baffles being generally defined by curved walls and micro-depressions formed in between adjacent curved walls of adjacent baffles; and a depression formed generally along and within the baffles, the depression being perpendicular with the bottle when the bottle is placed within the bottle loop.

10. The kit as claimed in claim 9 further comprising fasteners adapted to interconnect the main bib body with the bib pillow and the bib pillow with the bottle loop.

11. The kit as claimed in claim 9 further comprising connector loops connected to a border of the main bib body and leads adapted to be connected to the connector loops and the baby toys.

12. A bib system, comprising:

a main bib body having an upper surface and a lower surface;

a bib pillow having an upper and lower surface and a front end and a rear end, the lower surface of the bib pillow being connected to the upper surface of the main bib body, the upper surface being defined by a smooth curvature from the front to the rear end;

a bottle loop being closed and continuous and connected to the upper surface of the bib pillow and connected to the upper surface of the bib pillow;

a bottle having a nipple, the bottle being held against the upper surface of the bib pillow and within the bottle loop;

baby toys connected to leads that are connected to the main bib body;

baffles located on a front end of the bib pillow, the baffles being adapted to control the freedom of motion of the nipple when the bottle is placed in the bottle loop, the baffles being generally defined by curved walls and micro-depressions formed in between adjacent curved walls of adjacent baffles; and a depression formed generally along and within the baffles, the depression being perpendicular with the bottle when the bottle is placed within the bottle loop.

* * * * *